United States Patent [19]

Padovese et al.

[11] 4,173,960

[45] Nov. 13, 1979

[54] INDUCTIVE IGNITION CONTROL PULSE GENERATOR IN AN INTERNAL COMBUSTION ENGINE DISTRIBUTOR

[75] Inventors: Aldo A. Padovese, Santa Barbara d'Oeste; Giuseppe M. B. Trevisan; Emilio C. Sitar, both of Campinas, all of Brazil

[73] Assignee: Robert Bosch GmbH, Stuttgart, Fed. Rep. of Germany

[21] Appl. No.: 816,228

[22] Filed: Jul. 18, 1977

[30] Foreign Application Priority Data

Aug. 3, 1976 [BR] Brazil ..... PI 7605079

[51] Int. Cl.[2] ..... F02P 3/02; F02P 7/02

[52] U.S. Cl. ..... 123/146.5 A; 310/70 R

[58] Field of Search ..... 123/146.5 A, 148 E; 200/19 R, 19 M; 310/70 R, 70 A, 154, 155

[56] References Cited

U.S. PATENT DOCUMENTS

| | | | |
|---|---|---|---|
| 2,116,354 | 5/1938 | Bischoff | 310/70 R |
| 2,602,149 | 7/1952 | Brunelle, Jr. et al. | 310/70 R X |
| 3,254,247 | 5/1966 | Falge | 310/70 R |
| 3,265,931 | 8/1966 | Gerry | 123/148 AC |
| 3,289,020 | 11/1966 | Frank et al. | 310/70 R |
| 3,328,614 | 6/1967 | Falge | 310/70 R |
| 3,951,144 | 4/1976 | Siegle | 123/148 ND X |

*Primary Examiner*—Charles J. Myhre
*Assistant Examiner*—Tony M. Argenbright
*Attorney, Agent, or Firm*—Frishauf, Holtz, Goodman & Woodward

[57] ABSTRACT

An inductive pulse generator for producing control pulses for ignition timing is built into a conventional distributor designed for a mechanical circuit interruptor. The stator is mounted on a plate fastened to the interruptor carrier plate and consists of a pair of opposed coils on a common axis passing through the axis of the distributor shaft and a pair of opposed permanent magnets similarly mounted. The rotor has teeth of soft magnetic material in diametrically opposite pairs on rotor diameters forming equal angles between successive diameters. The rotor teeth pass by the coils and magnets with a small clearance and the symmetrical disposition of the coils and magnets provides immunity from much of the effect of vibrational forces which would otherwise disturb the constancy of the air gap width and consequently the regularity of the control pulses produced.

7 Claims, 1 Drawing Figure

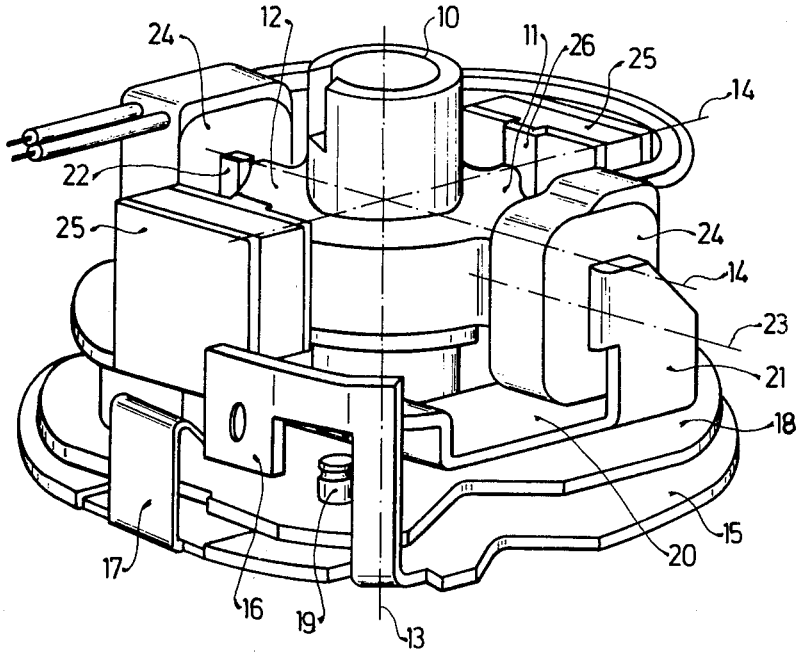
24
12
10
11
26
25
14
22
25
24
14
23
21
18
15
20
17
16
19
13

INDUCTIVE IGNITION CONTROL PULSE GENERATOR IN AN INTERNAL COMBUSTION ENGINE DISTRIBUTOR

This invention concerns a distributor of the inductive type for the ignition system of an internal combustion engine. In such distributors a rotor on the distributor shaft induces voltages in one or more coils of the stator affixed to the distributor casing and the stator may also include one or more permanent magnets.

An inductive pulse generator of the type above mentioned is useable in a contactless ignition coil system to generate several changes of current and to supply them to a pulse transformer to produce high voltage pulses. This is usually done by amplifying the current surges thus inductively generated in an amplifying stage operating practically in a switching mode and to provide the amplified surge to the control circuit of a switching transistor which will then suddenly cause generation of the ignition voltage for the engine in synchronism with the original current surge, which is therefore to be regarded as the control pulse for producing the ignition voltage pulse. For generation of the control pulse, a rotor made of magnetically soft material produces a change in the magnetic flux of the permanent magnets of the stator as the rotor rotates, causing a control voltage to be induced in the coil of the stator which contains positive and negative halfwaves.

Since the peak value of the control voltage is proportional to the rate of change of the magnetic flux picked up by the coils, the air gap between the rotor and the stator must be kept as small as possible.

In order to meet these requirements, inductive distributors have been made in which the stator is fastened either to a fixed carrier plate or to a pivoted interruptor plate. The latter arrangement is to be expected, since the inductive device above described performs the function of the conventional interruptor or breaker that times the ignition sparks of the engine, rather than the strictly distributive function (with reference to the sparkplugs of the several cylinders) from which the distributor gets its name. Since the distributor shaft which conventionally carries the interruptor cam is driven through a coupling that advances or retards its rotation by an angle dependent upon speed with respect to a driving shaft driven by the engine cam shaft and the coupling is controlled by the well-known centrifugal force arrangement, a considerable amount of wobbling is imparted to the motion of the rotor, whereas the stator does not participate in that wobbling movement, with the result that the manufacturing tolerances imposed by economic considerations which result in the amplitude of wobble impose characteristics on the size and variability of the air gap.

A distributor of this general type is also known in which the stator is mounted floating on a revolving bearing carrying the rotor. In this case the stator and the rotor both follow the wobble movements as well as axial up-and-down shifting of the rotor shaft, so that the air gap can be substantially smaller than in the case of the devices described above. This advantage, however, is obtained at the price of providing a large number of cooperating rotary parts.

It is an object of the present invention to provide a distributor assembly containing an ignition control pulse generator of the inductive type in which the inductive pulse generator is not subject to the influence of vibratory forces and in which the system of forces remains in balance.

SUMMARY OF THE INVENTION

Briefly, the coils and permanent magnets of the stator are provided in pairs, each pair being disposed diametrically to the distributor shaft and the angle between successive diametric dispositions thus provided are equal. By this arrangement, the respective masses are arranged symmetrically on their mounting plane and the effect of vibrations is thereby to a considerable extent eliminated from the inductive pulse generator.

If the coils and permanent magnets so arranged are mounted on a stator-carrying plate that is readily attachable to a pivoted conventional interruptor plate of a conventional distributor, it becomes easy to convert a distributor designed for a mechanical interruptor into a distributor assembly equipped with an inductive control pulse generator, without incurring substantial modification expense.

A space-saving and simple construction of the inductive pulse generator can be provided if at each coil position a tongue is bent up from the stator-carrying plate with its extremity again bent over and arranged to carry the coil, particularly when the axis of each coil is oriented radially with respect to the distributor shaft. It is also recommended to connect the coils of a diametral pair in series with each other, which noticeably increases the magnitude of the pulses generated. It has also been found that the magnetic flux is provided in its optimum condition if the polarity axis of each permanent magnet is oriented radially with respect to the distributor shaft. The facing poles of a diametral pair of permanent magnets should of course be of the same polarity.

The advantages of the invention result in large part from the fact that the radially symmetrical arrangement provides for a self-adjustment that produces greater constancy of the air gap width during operation. The invention also leads to the possibility of utilizing more effectively the available space in conventional distributor assemblies, so that instead of only one coil and one magnet, two or possibly more stator components can be provided. The advantage previously suggested, that distributor assemblies designed for mechanical interruptors can be equipped with inductive pulse generators at low cost should not be underestimated, because of the simplicity of the operation of fastening to the interruptor plate, instead of the usual contact carrier, a stator plate equipped with coils and permanent magnets.

The economy of the distributor assembly according to the present invention is illustrated by the fact that only six new component parts are needed in order to provide a 30% saving compared to previously known distributors, resulting in a reduction of the investment costs for tools and equipment.

The invention is further described with reference to the accompanying drawing, in the single FIGURE of which is given a perspective view of the pertinent portion of a distributor assembly with the casing removed and on a magnified scale.

In the drawing there is shown a distributor shaft 10 which rotates about the axis of rotation 13, to which is fastened a rotor 11 made of magnetically soft material and having four rotor teeth of magnetically soft material extending radially outward and offset from each other in the horizontal plane by 90°. The two diameters 14 drawn through the tops of pairs of rotor teeth 12 are in this case mutually perpendicular. For the general case, it is necessary only that successive diameters 14 should have equal angles between them.

A metal carrier plate 15 is equipped with two integral angle brackets 16, of which only one is visible in the drawing, for attaching the plate 15 to a distributor casing that is not shown in the drawing. A pair of oppositely disposed spring clips 17 are riveted to the carrier plate 15. An interruptor plate 18 is mounted so that it can pivot about the shaft axis on the carrier plate 15 and the spring clips 17 continuously press the interruptor plate 18 against the carrier plate 15, so that an easily working operative mounting is provided for the interruptor plate 18. A stud 19 sticks up from the interruptor plate 18 and serves for coupling with a rod of an unshown ignition timing shaft device operated by the intake vacuum of the engine.

The stator mounting plate 20 is preferably detachably fastened to the interruptor plate 18 by screw fastenings that are not shown in the drawing. First and second bracket tongues 21 extend up from the stator mounting plate 20 and their respective end portions 22 are bent over into the horizontal plane so that they are directed radially inwards towards the distributor shaft.

Each end portion 22 of a bracket tongue 21 carries a coil 24 in such a way that it is directed towards the distributor shaft 10 along the axis 23, the two coils 24 being connected in series. Similarly, two permanent magnets 25 are mounted on the stator plate 20 in such a way that their respective poles 26 are oppositely facing on a diametral axis with respect to the distributor shaft. These permanent magnets 25 are so mounted that a narrow air gap is provided between each pole and a passing rotor tooth 12. The number of rotor teeth 12 is usually, as in the present case, equal to the sum of the number of coils 24 and the number of permanent magnets 25, but it can also be a multiple of that sum.

The induction pulse generator consists essentially of the rotor 11 and the stator composed of the coils 24 and the permanent magnets 25. When the rotor is brought by rotation of the shaft 10 to the position indicated in the drawing, in which two oppositely extending rotor teeth 12 each face a pole 26 of one of the permanent magnets 25 or one of the ends 22 of a coil bracket serving as a core for a coil 24, a magnetic circuit is formed between each mutually adjacent coil 24 and permanent magnet 25. In this situation, in each such magnetic circuit, the flux passes through a path going from one rotor tooth 12, through the rotor to a neighboring tooth 12, across an air gap and through a coil 24, through the stator plate 20, through a permanent magnet 25 and, finally, from the pole 26 of the magnet across another air gap back to the rotor. In the illustrated position of the rotor, the magnetic flux reaches its maximum and the voltage induced in each coil reaches its highest positive value. As a rotor tooth 12 moves away from a pole 26 of a magnet 25 with rotation of the distributor shaft 10, the voltage very suddenly changes in sign and rises to its peak negative value. The ignition timing moment lies at the change from positive to negative voltage.

The illustrated device will produce four pulses per rotation of the distributor shaft. If twice as many teeth are provided on the rotor, there will be a pair of diametrically opposite teeth facing the magnets and another pair facing the coils eight times per revolution, so that there will be eight pulses per revolution. With an eight-tooth rotor, it would also be possible to provide two pairs of coils and two pairs of magnets, but in this case the axes of the magnet pairs and those of the coil pairs should be mutually at right angles and the angle between the axis of the coil pair and that of each of the adjacent magnet pairs will be 45°. In this case all four coils could be connected together, preferably in series.

Thus, it will be seen that although the invention has been particularly described with reference to a specific embodiment, modifications and variations are possible within the inventive concept.

We claim:

1. A distributor for an internal combustion engine comprising, in combination:

a carrier plate (15);

a rotatably mounted shaft (10) passing through said carrier plate;

an interruptor-positioning plate (18) mounted on said carrier plate so as to be shiftable rotatably about the axis of said shaft in response to an engine condition;

rotor (11) of magnetically soft material having at least two pairs of diametrically opposed teeth or cusps (12) distributed about its periphery and having the same maximum radius dimension;

at least one pair of diametrically opposed coils (24) and at least one pair of diametrically poled permanent magnets (25) mounted in fixed relation to said interruptor-positioning plate, said coils being centered on an axis that is diametric with respect to said rotor and the facing portions thereof being close to the path of said teeth or cusps of said rotor, said magnets having like poles facing each other with facing portions close to the path of said teeth or cusps of said rotor, the magnets being circumferentially interposed between coils and vice-versa;

said coils of each pair being connected together to produce a common response;

the number of said teeth or cusps being equal to the sum of the number of said magnets and the number of said coils, or a multiple of said sum, and the angles between successive rotor diameters (14) on which coil pairs and magnet pairs are aligned all being equal.

2. A distributor for an internal combustion engine as defined in claim 1, in which a single pair of said coils (24) and a single pair of said permanent magnets (25) are provided and in which said rotor has four teeth or cusps (12).

3. A distributor as defined in claim 1, in which said coils (24) and said permanent magnets (25) are mounted on an inductor support plate (20) which is detachably affixed to said interruptor-positioning plate (18).

4. A distributor as defined in claim 3, in which each of said coils is carried by the end portion (22) of a projection (21) bent up from said inductor support plate (20).

5. A distributor as defined in claim 1, in which said coils are each coaxial with the said diametric axis on which the respective coil is centered.

6. A distributor as defined in claim 1, in which the coils of each pair are connected electrically in series.

7. A distributor as defined in claim 1, in which the polarity axis of each of said permanent magnets (25) is radially oriented with respect to the distributor shaft.

* * * * *